US006666398B2

(12) United States Patent
Allegretto et al.

(10) Patent No.: US 6,666,398 B2
(45) Date of Patent: Dec. 23, 2003

(54) APPARATUS AND METHOD FOR WINDING OPTICAL FIBER ONTO REELS

(75) Inventors: Allen E. Allegretto, Wilmington, NC (US); Richard E. Blazek, Wilmington, NC (US); Robert D. Nichols, Wilmington, NC (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 10/061,933

(22) Filed: Jan. 31, 2002

(65) Prior Publication Data

US 2003/0141401 A1 Jul. 31, 2003

(51) Int. Cl.[7] ..... B65H 67/04; B65H 54/22

(52) U.S. Cl. ..... 242/476.6; 242/476.4; 242/476.5

(58) Field of Search ..... 242/474.7, 475, 242/476.4, 476.5, 476.6, 474.8

(56) References Cited

U.S. PATENT DOCUMENTS

| | | | | |
|---|---|---|---|---|
| 2,827,243 A | * | 3/1958 | Cadle | 242/476.6 |
| 4,181,267 A | * | 1/1980 | Schmitz-Steger | 242/476.6 |
| 4,848,687 A | | 7/1989 | Myers et al. | |
| 5,005,776 A | * | 4/1991 | Schwarz | 242/476.6 |
| 5,263,656 A | * | 11/1993 | Raasch | 242/476.6 |
| 5,441,215 A | | 8/1995 | Nagayama et al. | |
| 5,529,186 A | | 6/1996 | Bass | |
| 5,558,287 A | | 9/1996 | Darsey et al. | |
| 5,692,690 A | * | 12/1997 | Gulledge et al. | 242/476.6 |
| 5,761,368 A | | 6/1998 | Arnett et al. | |
| 5,875,626 A | * | 3/1999 | Cromartie | 242/476.6 |
| 5,917,983 A | | 6/1999 | Page et al. | |
| 5,964,431 A | | 10/1999 | Chang et al. | |
| 5,988,556 A | | 11/1999 | Bednarczyk et al. | |
| 6,152,399 A | | 11/2000 | Chang et al. | |
| D437,207 S | | 2/2001 | Bumgarner et al. | |
| 6,299,097 B1 | | 10/2001 | Bird et al. | |
| 6,305,639 B1 | | 10/2001 | Bocciola | |

FOREIGN PATENT DOCUMENTS

| | | |
|---|---|---|
| GB | 2 326 155 | 12/1998 |
| WO | WO00/40495 | 7/2000 |

* cited by examiner

*Primary Examiner*—Michael R. Mansen
(74) *Attorney, Agent, or Firm*—Joseph M. Homa

(57) ABSTRACT

A method and appartus for sandwiching the loose end of the optical fiber. A disk assembly is disclosed which includesa first disk capable of being mounted on the shaft proximate the first flange of the reel and a second disk capable of being mounted on the shaft proximate the first disk, wherein the first and second disks are capable of being spaced apart to accept the loose end of the optical fiber, and the first and second disks are capable of being moved together to sandwich the loose end of the optical fiber.

11 Claims, 11 Drawing Sheets

APPARATUS AND METHOD FOR WINDING OPTICAL FIBER ONTO REELS

BACKGROUND OF THE INVENTION

1. Field of the Invention

The present invention relates to a method and apparatus for winding a continuous length of optical fiber onto a reel or spool and, more particularly, to a method and apparatus for containing an end of the optical fiber.

2. Description of the Prior Art

Optical fiber is typically wound onto a shipping spool for internal processing, shipping to a customer, and subsequent processing at the customer's facility. In order to allow the entire length of the fiber to be tested for various attributes, such as attenuation, it is necessary to provide access to both ends of the wound fiber. It is also desirable to have access to both ends of the fiber so that fiber samples may be removed from either end for other optical and geometric measurements.

Thus, a manufacturer of optical waveguide fiber or optical fiber typically dispenses sections of optical fiber from one reel to another reel. For example, a bulk reel or bulk spool, which contains a relatively large amount of optical fiber, is typically transferred onto respective shipping spools, which are sent to customers. Both ends of the optical fiber on the shipping spool are desirably readily accessible for testing. Therefore, the manufacturer winds a first portion of the optical fiber onto a sample section of the shipping spool and winds the remainder of the optical fiber onto a separate, main section of the shipping spool. Known processes for winding the optical fiber onto the sample and main sections of the shipping spool include both manual and automatic winding steps. Accommodations must be made to provide access to the inner end of the optical fiber, also known as the "under-wrap" or the "lead meter," as that end lies under the optical fiber pack, which may consist of hundreds of layers of optical fiber wound onto a spool.

SUMMARY OF THE INVENTION

In one aspect, the present invention relates to an apparatus for sandwiching a loose end of the optical fiber wound on an optical fiber winding reel which is mounted on a rotatable shaft, the apparatus comprising a first member capable of being mounted on the shaft proximate the reel, and a second member capable of being mounted on the shaft proximate the first member, wherein the first and second members are capable of being spaced apart to accept the loose end of the optical fiber, and wherein the first and second members are capable of being moved together to capture the loose end of the optical fiber therebetween.

In one preferred embodiment, the first member is capable of being rotated by the shaft. In another preferred embodiment, the second member is capable of being rotated by the shaft.

Preferably, the apparatus further comprises a biasing member disposed between the first and second members. Preferably, the biasing member tends to force the first and second members away from each other, wherein the first and second members are spaced apart by the biasing member, and wherein the first and second members are capable of being positioned toward each other so as to sandwich the loose end of the optical fiber.

Preferably, at least one of the first member and the second member further comprises a resilient portion capable of contacting the loose end of the optical fiber.

The apparatus further preferably comprises a stop device capable of being mounted on the shaft proximate the second member, wherein the stop device is capable of limiting travel of the second member along the shaft.

The apparatus further preferably comprises a third member movably attached to the second member. Preferably, a second biasing member is disposed between the second and third members.

In another aspect, the present invention relates to an apparatus for reducing damage to optical fiber wound on an optical fiber winding reel which is mounted on a rotatable shaft, the apparatus comprising a first member capable of being mounted on the shaft proximate the reel, and a second member capable of being mounted on the shaft proximate the first member, wherein the first and second members are capable of sandwiching a loose end of the optical fiber therebetween. The first and second members are preferably capable of restricting the movement of the loose end of the optical fiber.

Preferably, at least one of the members mitigates bending in the loose end of the optical fiber.

Preferably, the first and second members are attached to each other.

The apparatus further preferably comprises a biasing member disposed between said first and second members. The first and second members are preferably spaced apart by the biasing member, wherein the first and second members are capable of being positioned toward each other sufficient to sandwich the loose end of the optical fiber.

The apparatus further preferably comprises a resilient member disposed between the first and second members, the resilient member being capable of contacting the loose end of the optical fiber. Preferably, the resilient member is disposed on at least one of the first and second members.

The apparatus further preferably comprises a stop member capable of being mounted on the shaft proximate the second member. Preferably, the stop member prevents movement of the second member along the axis of the shaft.

The apparatus further preferably comprises a third member movably attached to the second member. Preferably, a second biasing member is disposed between the second and third members.

In yet another aspect, the present invention relates to a disk assembly for use with an optical fiber reel assembly having a hub and a flange, the optical fiber reel assembly capable of being mounted on a rotatable shaft and holding optical fiber with a loose end, the disk assembly comprising a first disk capable of being mounted on the shaft proximate one of the flange of the reel, and a second disk capable of being mounted on the shaft proximate the first disk, wherein the first and second disks are capable of being spaced apart to accept the loose end of the optical fiber, and wherein the first and second disks are capable of being moved together to capture the loose end of the optical fiber.

In one preferred embodiment, the first disk is adapted to be rotated by the shaft. In another preferred embodiment, the second disk is adapted to be rotated by the shaft.

The disk assembly further preferably comprises a biasing member disposed between the first and second disks. Preferably, the first and second disks are spaced apart by the biasing member. The first and second disks are preferably capable of being positioned toward each other so as to sandwich the loose end of the optical fiber.

The disk assembly further preferably comprises a resilient member disposed between the first and second disks and capable of contacting the loose end of the optical fiber. Preferably, the resilient member is mounted on either the first disk or the second disk.

The disk assembly further preferably comprises a stop device capable of limiting travel of the second disk along , or parallel to, the shaft.

The disk assembly preferably further comprises a third disk movably attached to the second disk. Preferably, a second biasing member is disposed between the second and third disks for spacing the second and third disks apart. The second biasing member preferably allows the force with which the first and second disks grasp the end of the optical fiber to be adjustable.

In still another aspect, the present invention relates to a disk assembly in combination with an optical fiber reel assembly, the optical fiber reel assembly comprising a hub disposed between first and second flanges, the hub being capable of holding optical fiber with a loose end, wherein the optical fiber reel assembly is capable of being mounted on a rotatable shaft, and the disk assembly comprising a first disk capable of being mounted on the shaft proximate the first flange of the reel, and a second disk capable of being mounted on the shaft proximate the first disk, wherein the first and second disks are capable of being spaced apart to accept the loose end of the optical fiber, and wherein the first and second disks are capable of being moved together to sandwich the loose end of the optical fiber.

In a preferred embodiment, the first flange defines an aperture through which a leading portion of the optical fiber can be directed. The aperture may be a throughhole, a slit, or other type of opening.

Preferably, the outer diameter of the first disk is aligned with the aperture in the first disk.

The optical fiber reel assembly further preferably comprises an auxiliary hub extending from a side of the optical fiber reel assembly adapted to hold a leading portion of the optical fiber.

The optical fiber reel assembly further preferably comprises an auxiliary flange means disposed around the auxiliary hub, wherein the auxiliary flange means defines an aperture through which a leading portion of the optical fiber can be directed.

In one preferred embodiment, the auxiliary flange means preferably comprises an auxiliary flange wall. In another preferred embodiment, the auxiliary flange means comprises a plurality of radial tabs circumferentially spaced apart.

Preferably, the outer diameter of the first disk is aligned with the aperture in the auxiliary hub.

Preferably, the optical fiber reel assembly and the disk assembly comprise mating surfaces.

In yet another aspect, the present invention relates to a method of winding a continuous length of optical fiber from an optical fiber supply onto first and second sections of a spool, the method comprising the step of sandwiching leading end of a first portion of the continuous length of optical fiber. The method further preferably comprises the step of preliminarily winding the first portion of the continuous length of optical fiber to collect the first portion from the optical fiber supply while a second portion of the continuous length of optical fiber remains at the fiber supply. The method preferably further comprises winding the collected first portion onto the first section of the spool while the second portion remains at the optical fiber supply. The method preferably further comprises winding the second portion of the continuous length of fiber from the fiber supply onto the second section of the spool. In a preferred embodiment, the first and second portions constitute minor and major portions, respectively, of the continuous length of fiber. In a preferred embodiment, the leading end of the first portion of the continuous length of optical fiber is sandwiched between at least two rigid members. Preferably, the at least two rigid members are mounted on a common shaft with the spool.

Additional features and advantages of the present invention will become apparent by reference to the following detailed description and accompanying drawings.

DETAILED DESCRIPTION

An optical fiber supply preferably includes a first spool, which has optical fiber wound thereon, and a first spool control device, which controls the rotation of the first spool by controlling rotation of a shaft upon which the first spool is mounted. The optical fiber supply may also include conventional components (not shown), such as pulleys, that tension the optical fiber and otherwise assist in the winding process. A processor communicates with the first spool control device to control the supply of optical fiber by the optical fiber supply.

A sample section winding device preferably includes a reel which accepts a free end or leading end of the first portion of the continuous length of optical fiber.

In one method for making optical fiber, during the "draw" phase of the process, optical fiber is drawn from a blank form at a draw tower and then wound onto a bulk spool. In the "screening" phase of the process, the bulk spool is taken "off-line," i.e., disconnected from the optical fiber output of the draw tower, and then placed onto an off-line screening machine (OLS). There, the optical fiber is tested for strength, cut to length, and then wound onto a shipping spool for further processing and shipping.

In the draw phase, the optical fiber is preferably wound onto the bulk spool by rotating the spool at high speed as optical fiber is fed onto the spool by a flying head that travels alongside the spool, up and down its length. In the screening phase, an alternative winding technique may be used, in which the optical fiber is wound onto the shipping spool by rotating the spool at high speed and moving the spool back and forth along its longitudinal axis as optical fiber is fed thereon. It will be appreciated in light of the following discussion that the present invention can be practiced with either of these, or other, types of winding setup.

Figure 1:
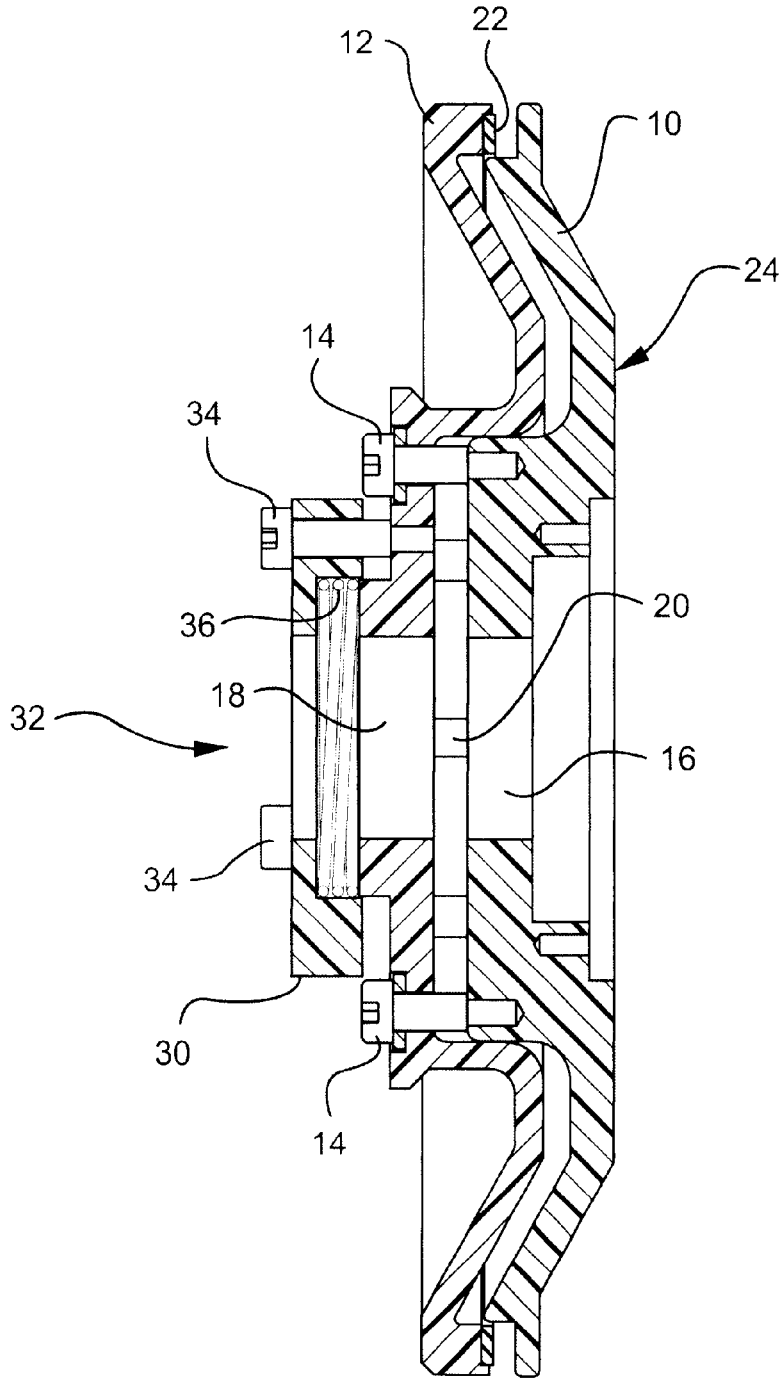
FIG. 1 is an elevantional cross-sectional view of the apparatus as disclosed herein shown in the open position.
Figure 2:
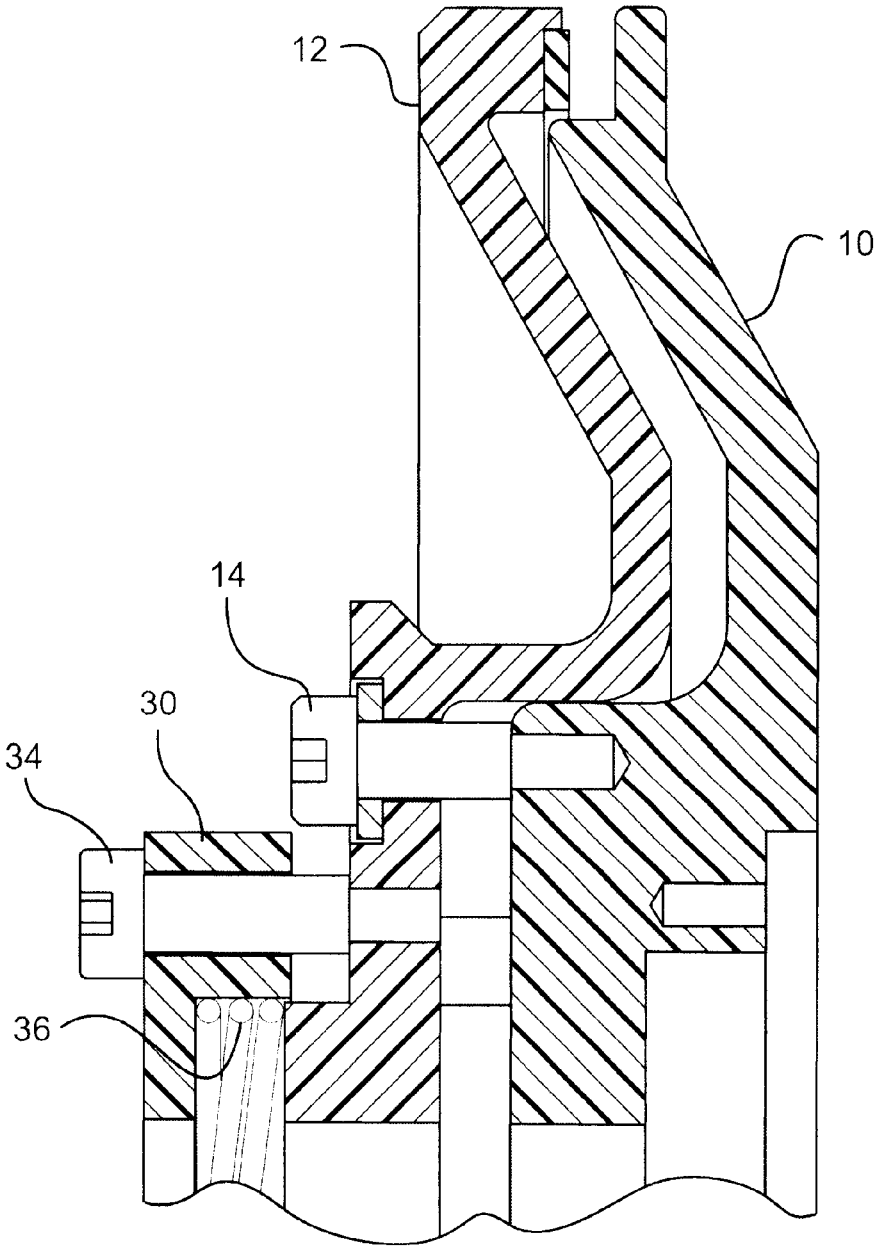
FIG. 2 is a close-up elevantional cross-sectional view of the apparatus of FIG. 1 shown in the open position.
Figure 3:
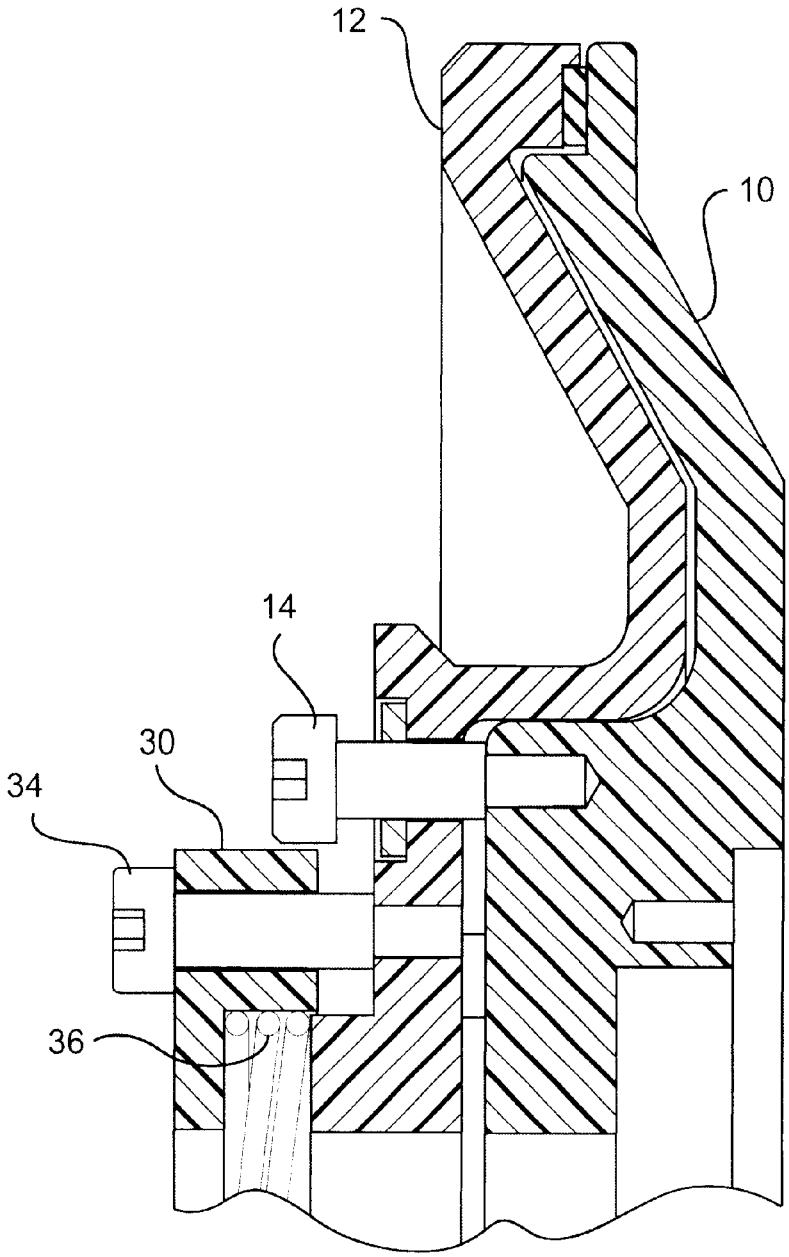
FIG. 3 is a close-up elevantional cross-sectional view of the apparatus of FIG. 1 shown in the closed position.

FIGS. 1 through 3 show a preferred embodiment of an apparatus as disclosed herein.

FIG. 1 shows a first member, in the form of first disk 10, and a second member, in the form of second disk 12, which are attached to each other with fasteners 14, such as shoulder bolts, which allow the first and second disks 10, 12 to move with respect to each other. The first disk and second disks 10, 12 each define a respective central opening 16, 18 adapted to allow the respective disks to be mounted on a shaft. As shown in FIGS. 1–2, the first and second disks 10, 12 are capable of being spaced apart to accept a loose end of optical fiber, and the first and second disks 10, 12 are capable of being moved together to capture the loose end of the optical fiber as shown in FIG. 3. Preferably, one or more biasing members 20 are disposed between the first and second disks 10, 12 for providing a force which tends to separate the first and second disks 10, 12. Preferably, the first and second disks 10, 12 are spaced apart by the biasing member 20. In embodiments where the biasing member 20 is absent, the user would need to pry apart the first and second disks 10, 12 without the assistance of the biasing member 20, e.g. manually or with the assistance of a tool or other apparatus.

Furthermore, the first and second disks 10, 12 are capable of being positioned toward each other so as to sandwich the loose end of the optical fiber therebetween.

A resilient member 22, such as a rubber gasket, is disposed between the first and second disks 10, 12 and is positioned so as to be capable of contacting the loose end of the optical fiber when the fiber is placed between the first and second disks 10, 12. The resilient member 22 is shown as being mounted on the second disk 12, although the resilient member 22 may be mounted on either the first disk 10 or the second disk 12.

Preferably, the inner transverse surface 24 of the first disk 10 which faces the reel is formed to mate with the outer transvese surface of the reel which faces the first disk 10.

A known stop device, not shown in the Figures, which is capable of limiting travel of the second disk along or parallel to the shaft can be used to mount the first and second disks 10, 12 on a shaft in proximity to an optical fiber reel. Preferably, the stop device is a lock device which is selectively fixed to the shaft, preferably at a desired position along the length of the shaft.

As seen in FIGS. 1–3, a third member, shown in the form of third disk 30, is preferably provided which provides a surface or point upon which an axial force, i.e. parallel to the rotational axis of the shaft as generally illustrated by the directional arrow 32 in FIG. 1, can be exerted on the second disk 12 without interfering with a portion of the first disk 10. Alternatively, the second disk 12 includes a projection which allows a force to be applied to the outer surface of the second disk without interfering with the relative movement between the first and second disks 10, 12. Preferably, the second and third disks 12, 30 are attached to each other with fasteners 34, such as shoulder bolts, which allow the second and third disks 12, 30 to move with respect to each other.

Preferably, a second biasing member 36, such as a wavespring, is disposed between the second and third disks 12, 30 shown being positioned, in the annular space defined by the inner surface of the third disk 30 and the outer surface of the second disk 12. The second biasing member 36 provides a force which tends to separate the second and third disks 12, 30. The relative positioning between the second and third disks 12, 30 and, in conjunction with the second biasing member 36, provides the ability to select and/or adjust the axial force exerted against the apparatus, as well as against the optical fiber end. For example, the third disk 30 and second biasing member 36 can better accommodate any tolerances that may be present in the winding system, such as in the sizing and/or positioning of reels or shaft attachment points. Thus, a stop device is provided to limit travel of the third disk 30 along or parallel to the shaft and the "give" of the second biasing member 36 allows variations in sizes and positions of the remainder while providing sufficient force to maintain a grasp on the fiber end. Preferably, the stop device is a lock device which is selectively fixed to the shaft, preferably at a desired position along the length of the shaft. For example, the lock device may include a movable pin or bearing assembly which mates with an indentation in the shaft.

FIGS. 4 through 8 illustrate various optical fiber reels with which the disk assembly may be used in combination.

Figure 4:
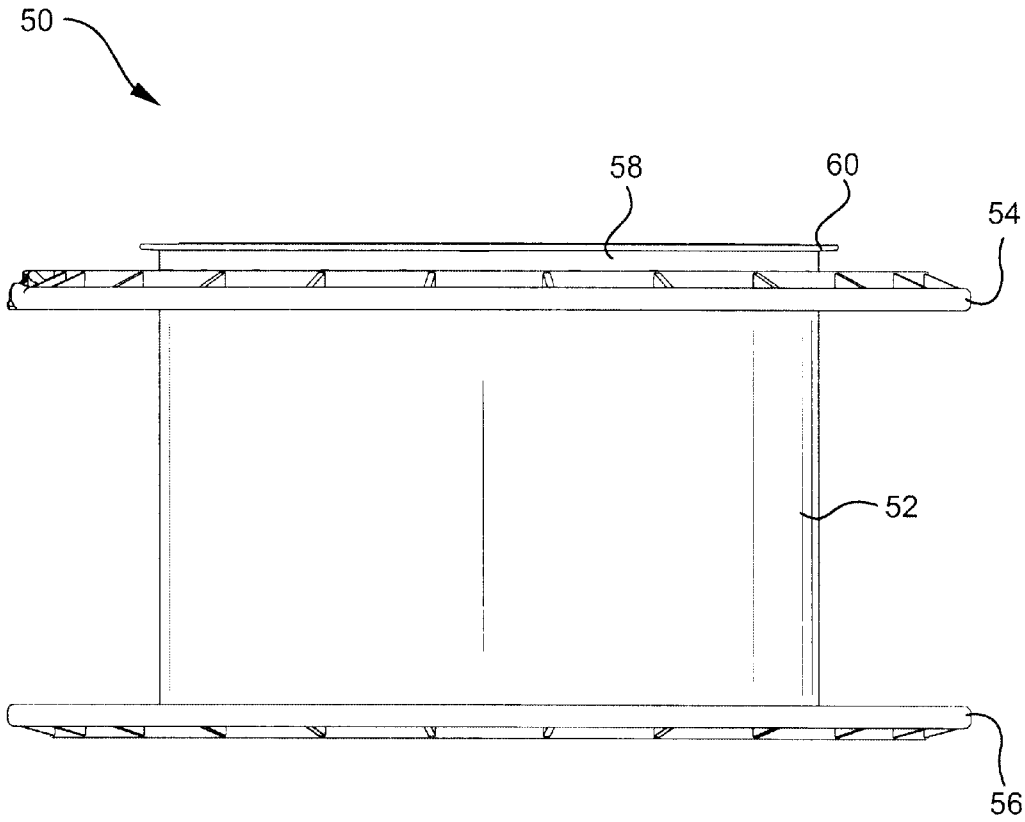
FIG. 4 PRIOR ART
FIGS. 4 and 5 show two orthogonal views of a known shipping spool.
Figure 5:
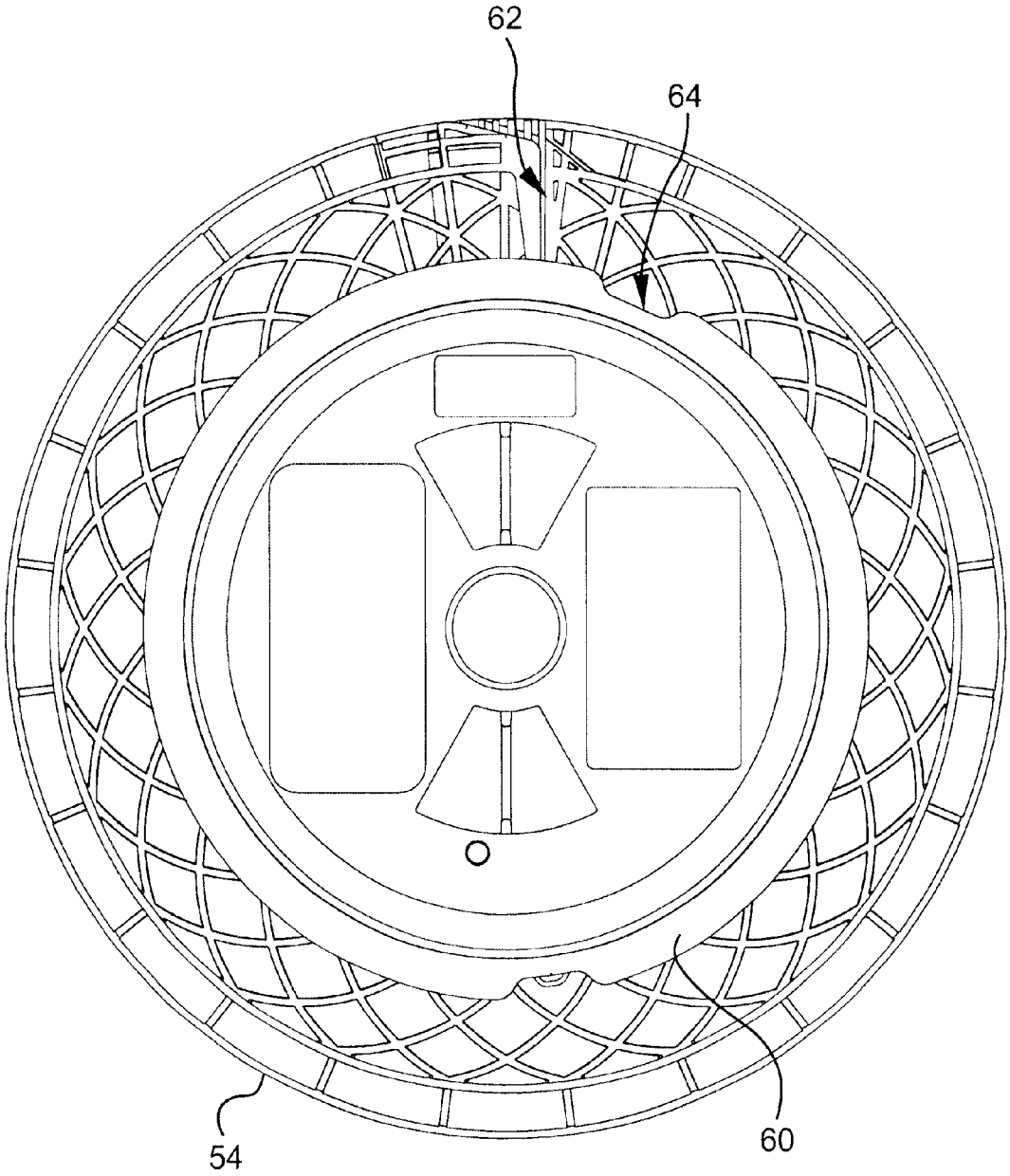
FIG. 5 PRIOR ART

FIGS. 4 and 5 show, respectively, side and front views of a known shipping spool 50. As shown in FIG. 4, the spool 50 includes a primary hub 52, around which the optical fiber is wound. The outside limits of the fiber wound onto the primary hub 52 are defined by outboard and inboard flanges 54 and 56. The spool 50 shown in FIGS. 4 and 5 further includes an auxiliary hub or a lead meter hub 58 around which the lead meter portion of the optical fiber is wound. The auxiliary hub 58 protrudes from outboard flange 54. The lead meter hub 58 is separated from the primary hub 52 by the outboard flange 54. The outside limits of the lead meter hub 58 are defined by the outboard flange 54 and a lead meter flange 60. As is apparent from FIGS. 4 and 5, the lead meter hub 58 and lead meter flange 60 lie along the same longitudinal axis as the primary hub 52 and outboard and inboard flanges 54 and 56.

The shipping spool shown in FIGS. 4 and 5 includes a slot 62 in the outboard flange 54. The slot 62 replaces the lead meter hole found in other known spools discussed below and extends from the surfaces of the primary and lead meter hubs 52, 58 to the outer periphery of the outboard flange 54. Flange 60 defines an aperture 64.

Figure 6:
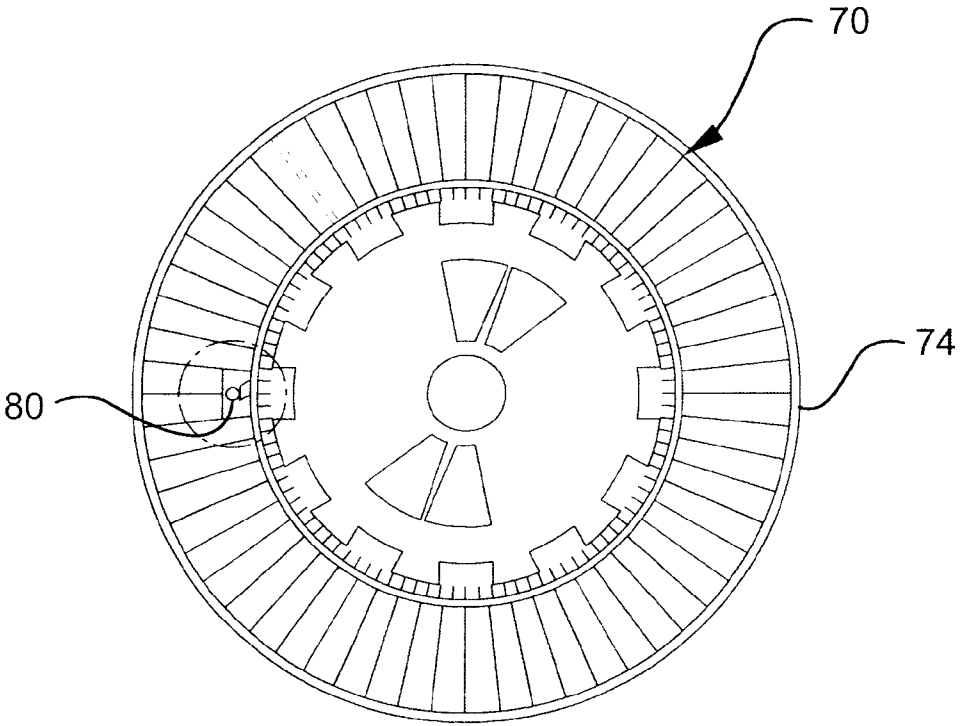
FIG. 6 PRIOR ART
FIGS. 6 and 7 show two orthogonal views of another known shipping spool.
Figure 7:
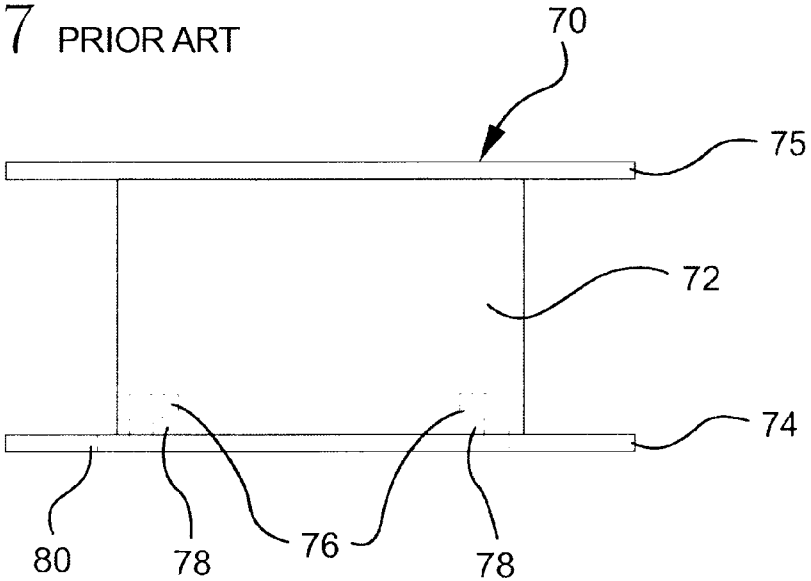
FIG. 7 PRIOR ART
Figure 8:
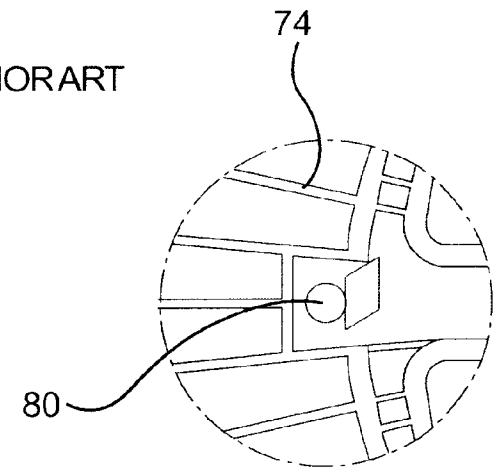
FIG. 8 PRIOR ART
FIG. 8 shows a close-up view of a lead meter hole in the shipping spool shown in FIGS. 6 and 7.
Figure 9:
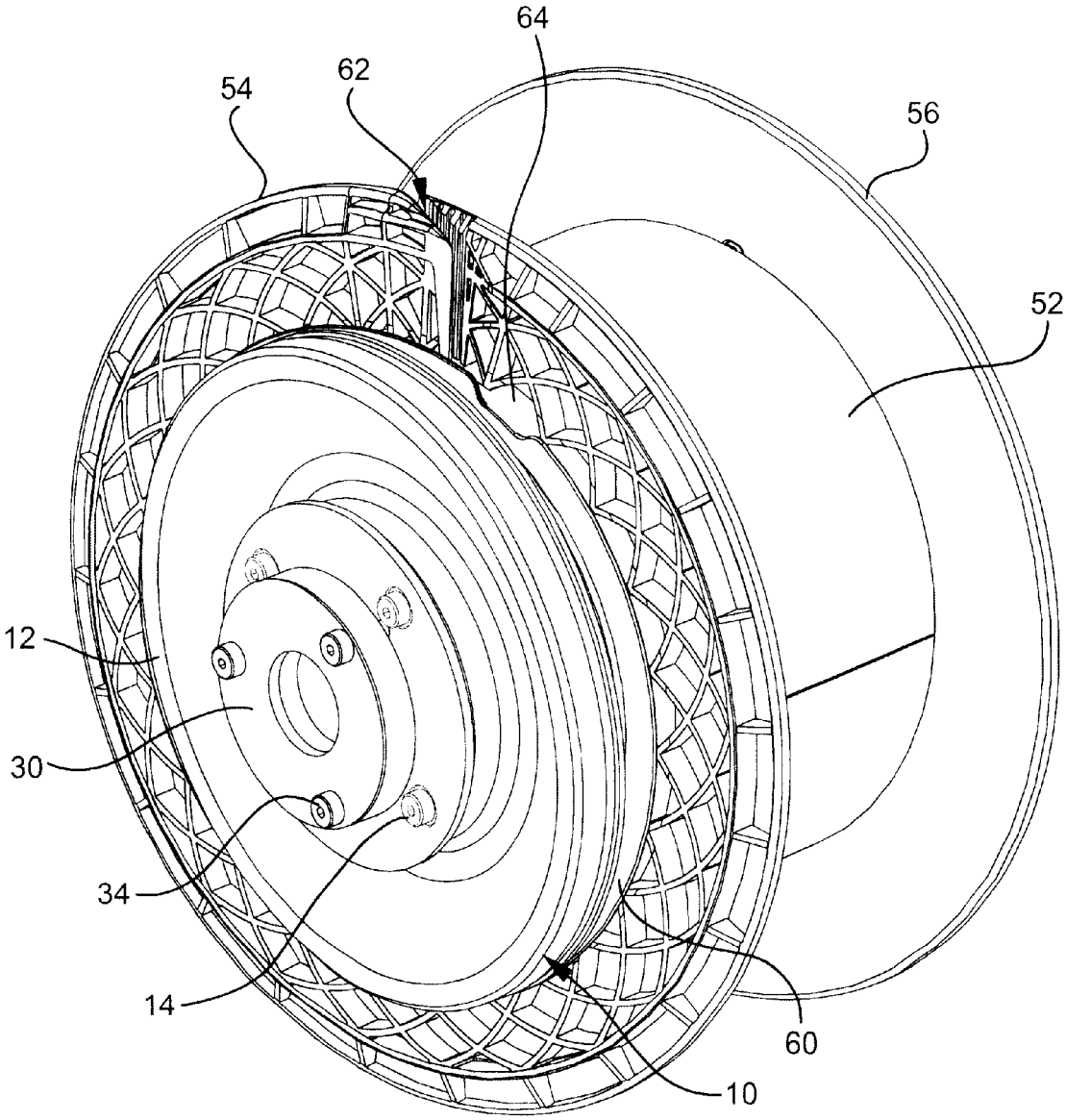
FIG. 9 is an isometric view of the apparatus proximate a reel as disclosed herein.
Figure 10:
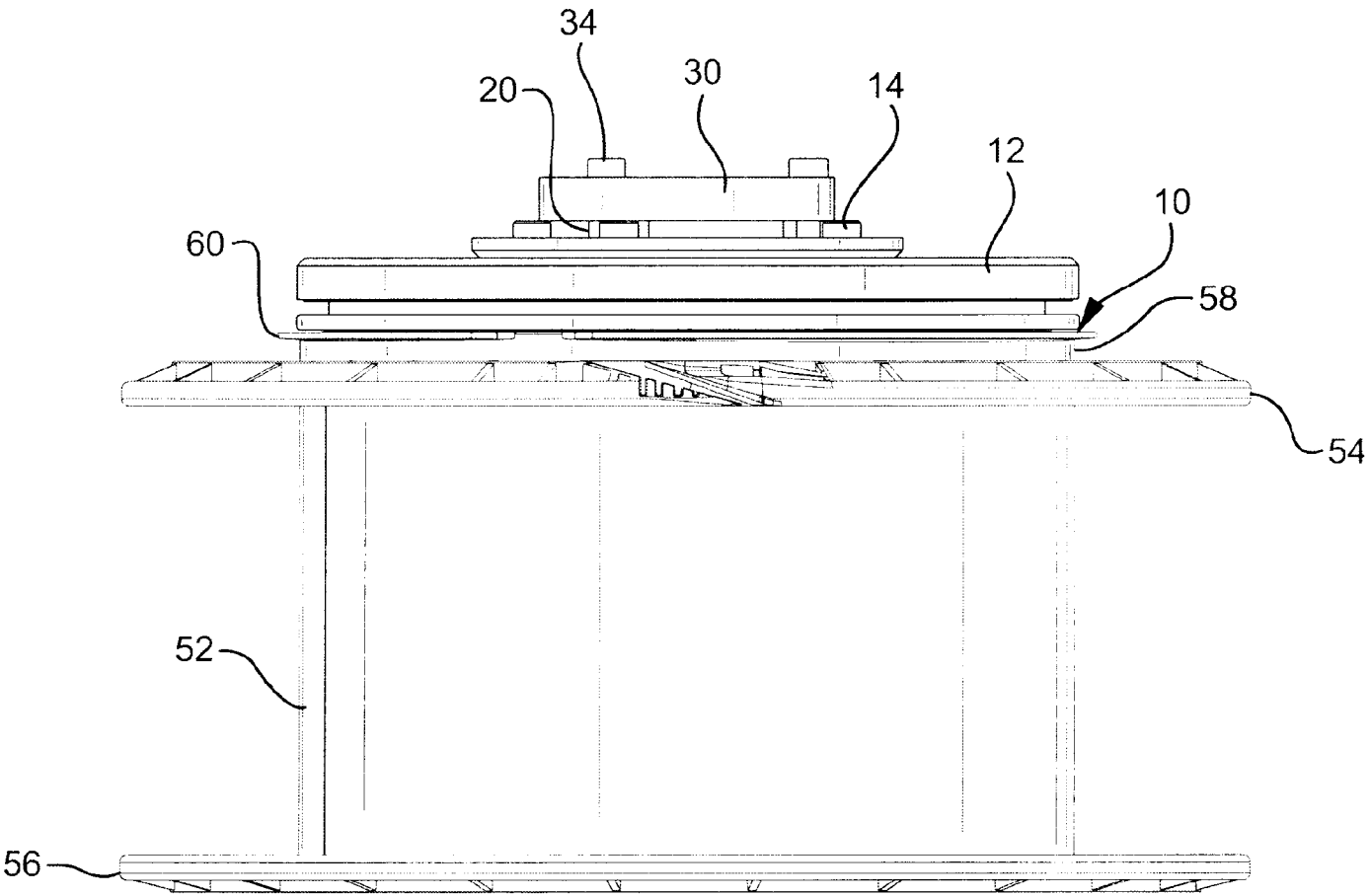
FIG. 10 is an elevational view of the apparatus and reel of FIG. 9.
Figure 11:
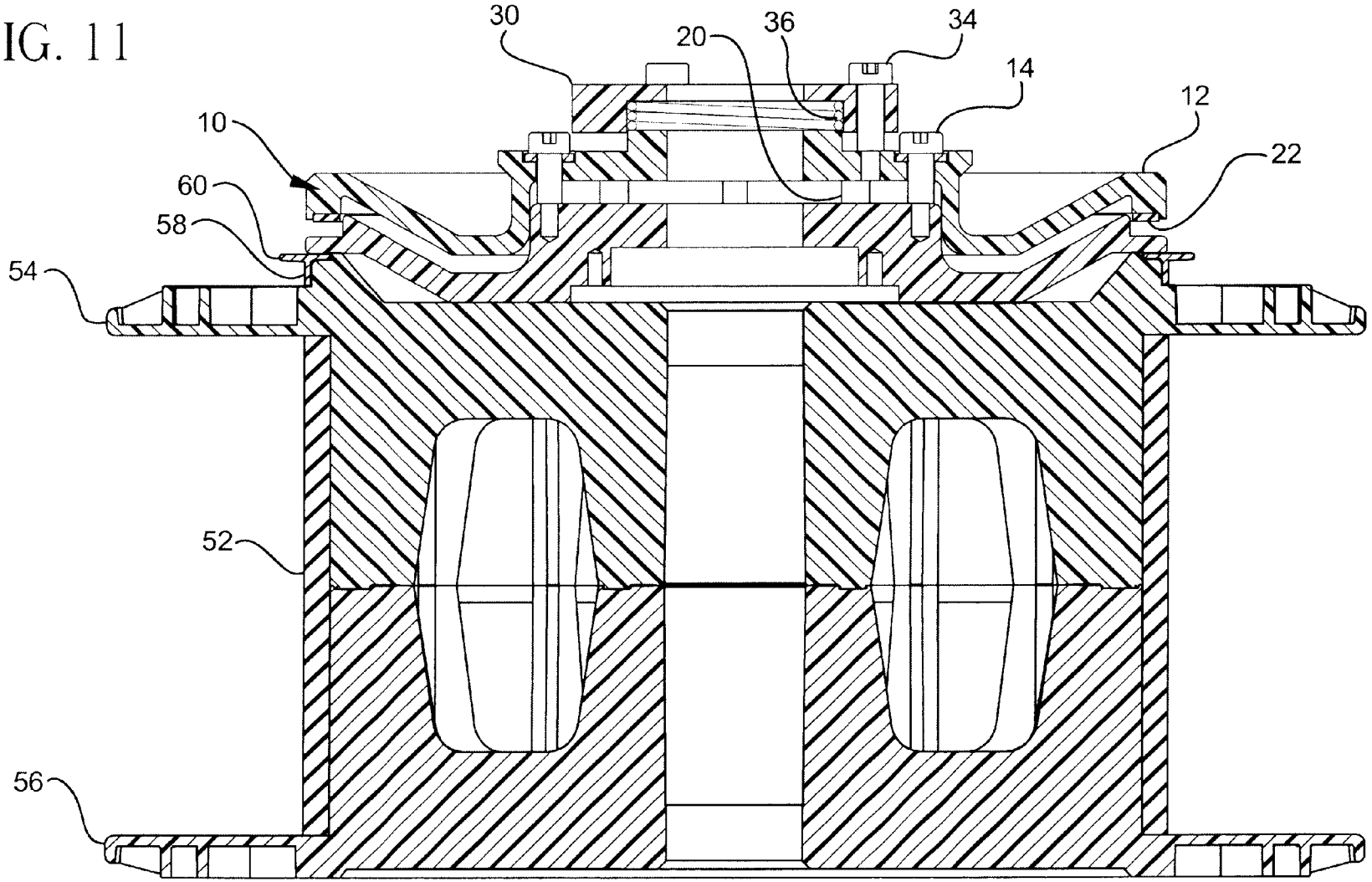
FIG. 11 is an elevational cross-sectional view of the apparatus and reel of FIG. 10.
Figure 12:
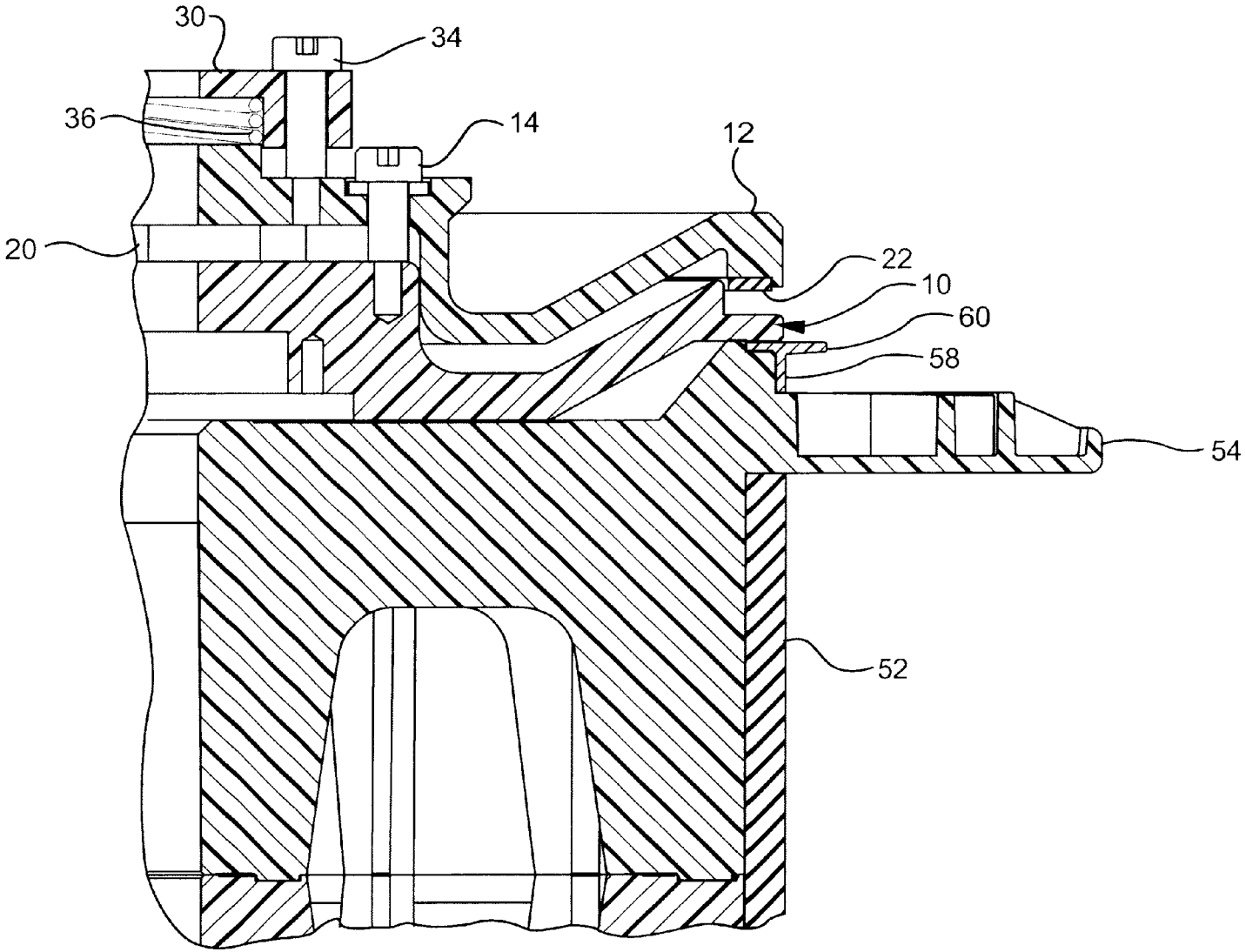
FIG. 12 is a close-up elevational cross-sectional view of the apparatus and reel of FIG. 11.

FIGS. 6 and 7 show, respectively, side and front views of another known optical fiber shipping spool 70. As shown in FIG. 7, the spool 70 includes a cylindrical primary hub 72, around which the optical fiber is wound, and first and second flanges 74 and 75 that define outside limits for the fiber being wound onto the primary hub 72. In addition, the shipping spool 70 includes a recessed cylindrical lead meter hub portion 76 that is integrally formed into the first flange 74. The lead meter hub portion 76 includes a lead meter flange portion 78. A lead meter hole 80 is provided in the first flange 74, providing a pathway for optical fiber between the lead meter hub 76 and the primary hub 72. FIG. 8 shows a close-up view of the lead meter hole 80 in the first flange 74.

Lead-meter or under-wrap access on the shipping spool shown in FIGS. 6–8 is provided as follows. First, a bulk spool wound with fiber is loaded onto the pay-out side of an off-line screening machine, and an empty shipping spool 70 of the type shown in FIGS. 6–8 is loaded onto the receiving side of the machine. Second, the end of the fiber is unrolled from the bulk spool and then threaded through the pulleys on the machine to the shipping spool 70. Third, the end of the fiber is threaded from the inside of first flange 74 of the shipping spool through lead meter hole 80. A length of approximately five to ten meters of fiber, enough for twenty revolutions around the lead meter hub, is pulled through the lead meter hole 80 and then manually wound onto the lead meter hub 76. Once the lead meter hub 76 has been wound, the screening machine is started, and optical fiber is automatically wound onto the primary hub 72 between the first and second flanges 74 and 75 of the shipping spool 70.

A five- to ten-meter length of fiber wound onto the lead meter hub typically provides a sufficient amount of fiber for: (1) optical access for double-ended optical time-domain reflectometer (OTDR) measurements, (2) samples to check other optical and geometric properties, and/or (3) fiber to be used by the customer for additional optical measurements.

Thus, an optical fiber reel typically includes a flange which defines an aperture through which a leading portion of the optical fiber can be directed. For example, the aperture may be a throughhole, as shown in FIG. 8 or a slit as shown in FIG. 5.

In one preferred family of apparatus, the outer diameter of the first disk 10 is radially aligned with the aperture in the flange preferably near the hub in order to reduce bending of the leading end of the optical fiber, especially avoiding bending at angles near 90°, since the optical fiber can traverse the distance from the reel to the first disk preferably along a substantially constant diameter path as defined from the axis of shaft rotation.

An optical fiber reel may further comprise an auxiliary hub extending from a side of the optical fiber reel, the auxiliary hub being adapted to hold a leading portion of the optical fiber. The reel may also comprise an auxiliary flange means disposed around the auxiliary hub, wherein the auxiliary flange means defines an aperture through which a leading portion of the optical fiber can be directed. The auxiliary flange means may comprise an auxiliary flange wall as seen in FIG. 5 or a plurality of radial tabs circumferentially spaced apart as seen in FIG. 6. In those cases, the outer diameter of the first disk is preferably radially aligned with the aperture proximate the auxiliary hub. Thus, bending of the leading end of the optical fiber is mitigated since the optical fiber can traverse the distance from the auxiliary hub of the reel to the first disk preferably along a substantially constant diameter path from the axis of shaft rotation.

FIGS. 9 through 12 show the disk assembly positioned proximate an exemplary reel.

The winding process is commenced by mounting the empty spool onto a spindle assembly, mounting the disk assembly and sandwiching the end of the optical fiber. Once the end of the fiber is sandwiched, the spool is rotated, and optical fiber begins to wind onto the lead meter barrel.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. An apparatus for sandwiching a loose end of the optical fiber wound on an optical fiber winding reel which is mounted on a rotatable shaft, the apparatus comprising:

a first member capable of being mounted on the shaft proximate the reel;

a second member capable of being mounted on the shaft proximate the first member; and a biasing member disposed between the first and second members;

wherein the first and second members are capable of being spaced apart in an open position by the biasing member to accept the loose end of the optical fiber; and wherein the first and second members are capable of being moved together to sandwich the loose end of the optical fiber therebetween in a closed position.

2. The apparatus of claim 1 wherein at least one of the first member and the second member further comprises a resilient portion capable of contacting the loose end of the optical fiber.

3. The apparatus of claim 2 wherein the resilient portion on one of the first and second members does not contact the other of the first and second members in the open position.

4. The apparatus of claim 1 further comprising a third member movably attached to the second member and capable of being mounted on the shaft proximate the second member.

5. The apparatus of claim 4 further comprising a second biasing member disposed between the second and third members.

6. The apparatus of claim 5 wherein the second and third members are spaced apart by the second biasing member.

7. A disk assembly for use with an optical fiber reel assembly having a hub and a flange, the optical fiber reel assembly capable of being mounted on a rotatable shaft and holding optical fiber with a loose end, the disk assembly comprising:

a first disk capable of being mounted on the shaft proximate the flange of the reel;

a second disk capable of being mounted on the shaft proximate the first disk; and a biasing member disposed between the first and second disks;

wherein the first and second disks are capable of being spaced apart in an open position by the biasing member to accept the loose end of the optical fiber; and wherein the first and second disks are capable of being moved together to sandwich the loose end of the optical fiber in a closed position.

8. The apparatus of claim 7 further comprising a resilient member disposed between the first and second disks and capable of contacting the loose end of the optical fiber, wherein the resilient member is mounted on either the first disk or the second disk.

9. The apparatus of claim 7 further comprising a third disk movably attached to the second disk and capable of being mounted on the shaft proximate the second disk.

10. The apparatus of claim 9 further comprising a second biasing member disposed between the second and third disks.

11. The apparatus of claim 10 wherein the second and third disks are spaced apart by the second biasing member.

* * * * *